United States Patent [19]

Zampini et al.

[11] 4,327,556

[45] May 4, 1982

[54] FAIL-SAFE ELECTRONICALLY CONTROLLED DEFROST SYSTEM

[75] Inventors: Joseph J. Zampini; Paul R. Buda, both of Liverpool, N.Y.; Luis E. Prada, Louisville, Ky.

[73] Assignee: General Electric Company, Syracuse, N.Y.

[21] Appl. No.: 147,830

[22] Filed: May 8, 1980

[51] Int. Cl.[3] ..... F25D 21/06

[52] U.S. Cl. ..... 62/153; 62/155; 62/234

[58] Field of Search ..... 62/155, 157, 158, 234, 62/153

[56] References Cited

U.S. PATENT DOCUMENTS

| | | | |
|---|---|---|---|
| 3,460,352 | 8/1969 | Lorenz | 62/155 |
| 3,890,798 | 6/1975 | Fujimoto et al. | 62/234 |
| 4,197,717 | 4/1980 | Schumacher | 62/234 |
| 4,251,999 | 2/1981 | Tanaka | 62/155 |

*Primary Examiner*—Albert J. Makay
*Assistant Examiner*—Harry Tanner
*Attorney, Agent, or Firm*—Richard V. Lang; Carl W. Baker

[57] ABSTRACT

A fail-safe electronically controlled defrost system is provided for use in a frost-free refrigerator suitable for home use. The defrost cycle, in the interests of power conservation, is made subject to plural input electronic control in a circuit in which the intrinsic reliability of the defrost system is specifically designed to revert to a non-power conservation mode in the event of failure of the electronics. Compressor time, door openings and user (vacation mode) settings are typical inputs for control of the period between defrosts.

11 Claims, 5 Drawing Figures

MICROPROCESSOR

FAIL-SAFE ELECTRONICALLY CONTROLLED DEFROST SYSTEM

BACKGROUND OF THE INVENTION

1. Field of the Invention

The invention relates to refrigeration systems, and more particularly to frost-free refrigeration systems for home use in which an automatically controlled defrost heater is provided incorporating a defrost heater.

2. Description of the Prior Art

Previously, the defrost cycle of a frost-free refrigerator was controlled by a timing motor connected directly across the compressor motor. Thus, whenever the compressor motor ran, the defrost motor ran, and after about eight (8) hours of compressor run-time, the defrost timer reached the defrost mode. The compressor was shut off, while maintaining power to the defrost timer. At this time the defrost heaters were energized as well as a condenser fan, and the frost build-up was melted and collected in the evaporating pan in the machinery compartment to be evaporated. The defrost heaters use a lot of energy, and this method of defrost cycle control is sub-optimal in situations where the doors of the refrigerator are not opened for extended periods of time, e.g., when the owner is on vacation or at night. Under these circumstances, no moisture enters the refrigerator, and the length of time between defrosts may be extended without the fear of excessive frost build-up. With the advent of microprocessor controlled appliances, it is possible to detect these situations and lengthen the defrost cycle appropriately. A shortcoming of the electronic control system was that the defrost system was not protected from catastrophic failure of the electronics; if the electronics failed in such a way as to disable power to the defrost timer, the defrost system would not cycle. Two modes of defrost failure can be identified. First, it is possible for the system to fail with the defrost heaters off, in which case a frost build-up would occur restricting the air flow between the freezer compartment and the fresh food compartment, causing an eventual overheating of the fresh food side. Even more detrimental is the mode in which the system fails with the defrost heaters on and the compressor disabled, in which case the refrigerator rapidly overheats. The bi-metal thermostat in series with the defrost heaters will interrupt the power, but the compressor will remain disabled.

SUMMARY OF THE INVENTION

Accordingly, it is an object of the present invention to provide in a refrigeration system an improved automatically controlled defrost system.

It is a further object of the present invention to provide in a refrigeration system an automatically controlled defrost system having reduced power consumption.

It is another object of the present invention to provide in a refrigeration system an electronically controlled defrost system of high reliability.

It is another object of the present invention to provide in a refrigeration system an electronically controlled defrost system of high reliability and reduced power consumption.

These and other objects of the invention are achieved in a self-defrosting refrigeration system including an evaporator subject to frost build-up; an electrically powered, motor driven compressor for circulating coolant through the evaporator. These elements are powered from a conventional alternating current source under the control of a thermostat to maintain the refrigerator temperature at a desired value, a defrost timing switch setting a minimum defrost period, a defrost delay relay, an electronic decision element or microprocessor for computing a suitable amount of extension of the defrost period consistent with the circumstances and a fail-safe coupling circuit installed between the decision element and the defrost delay relay.

The defrost timing switch includes a timing motor and a two condition switch permitting either compressor operation or defrost heater operation when the thermostat is closed as a function of the time that the timing motor is energized. The defrost delay relay includes an operating winding and a pair of normally closed contacts which open when the operating winding is suitably energized. The thermostat contacts, the timing motor and the defrost delay relay contacts are serially connected between the ac input terminals so that energizstion of the timing motor only occurs when both the thermostat and the defrost delay relay contacts are closed.

The electronic decision element is responsive to input information supplied by the user or other sensors for determining the extension of the defrost period beyond the minimum period set by the defrost timing switch. It produces an output signal having a duration dependent on the input information and equal to the computed delay. The decision element is coupled by the fail-safe coupling circuit to the relay operating winding for opening the relay contacts to achieve the desired extension in the period between defrostings. In a preferred form, the electronic decision element is a microprocessor (integrated circuit) producing a sequence of output pulses, characteristic of the decision element, whose presence is generally indicative of proper operation of the decision element.

The ac source is of a conventional low frequency (50–60 hertz, while the output signal of the decision element is at a substantially higher frequency (1 kHz). The fail-safe coupling means is then designed to provide frequency dependent coupling to provide response to the periodic pulses produced by the decision element and non-response to direct current or low frequency alternating current quantities at the same coupling interface.

The fail-safe coupling circuit includes an amplifier responding to the pulse sequence from the decision element and a pulse detection circuit, to which the amplifier output is supplied, and will operate the defrost delay relay when amplified pulses are supplied thereto.

In a preferred form, the amplifier is a pulse amplifier having a predetermined input threshold and a binary output characterized by a first and second output state, dependent on whether or not the input signal exceeds the threshold. Consistently, the decision element produces a sequence of periodic pulses whose amplitudes exceed the threshold of the pulse amplifier.

The pulse detection circuit comprises a capacitor having a first terminal coupled to the output of the pulse amplifier and two rectifiers. The rectifiers are serially connected in like polarity across the operating winding. The second terminal of the capacitor is connected to the rectifier interconnection. The rectifiers are connected in a sense to charge the capacitor through one rectifier when the pulse amplifier output is in a first output state and to discharge the capacitor through the other rectifier and the operating winding when the pulse amplifier output is in the second output state to operate the defrost delay relay. The capacitor value is selected to provide sensitive relay operation at the frequency of the microprocessor pulse sequence while being insensitive to periodic waveforms at the fundamental or ripple frequencies of the ac power source.

In a preferred form, the pulse amplifier includes two transistor amplifiers, one being on when the other is off under the control of the decision element and effectively interconnecting the first terminal of the capacitor to either the positive or the negative terminal of the dc bias source. Thus, when the "first" amplifier is off and the "second" amplifier is on, a charging voltage is applied from the positive terminal of the bias supply to the capacitor. Similarly, when the "first" amplifier is on and the "second" amplifier is off, the capacitor is discharged to the negative terminal of the bias supply in a path including the relay winding and which energizes the relay.

BRIEF DESCRIPTION OF THE DRAWINGS

The novel and distinctive features of the invention are set forth in the claims appended to the present application. The invention itself, however, together with further objects and advantages thereof may be best understood by reference to the following description and accompanying drawings in which:

DESCRIPTION OF THE PREFERRED EMBODIMENT

Figure 1:
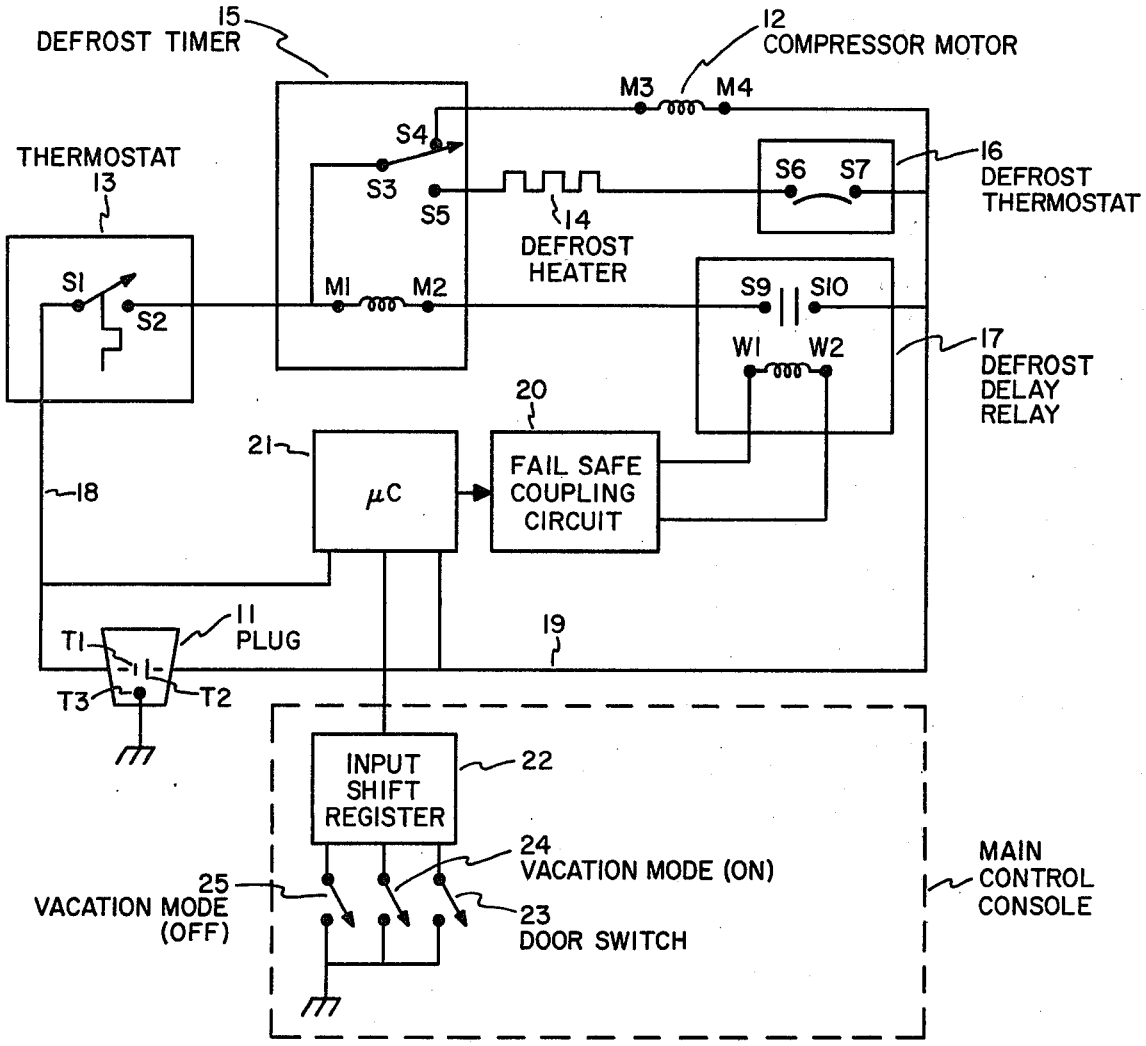
FIG. 1 is a simplified block diagram of a household refrigeration defrost control system having special "vacation mode" setting for reducing the frequency of defrosting and conserving power when the owners intend to be away.

In FIG. 1, a simplified electrical block diagram of an automatically controlled defrost system for a refrigerator is shown. The system includes a microprocessor to extend the interval between defrostings dependent on the circumstances for optimum power conservation. In addition, the microprocessor is connected into the defrost control circuit through a fail-safe coupling circuit in such a manner that failure of the microprocessor or fail-safe coupling circuit provides only a loss of the power conservation feature and does not significantly affect the reliability of defrost operation in the non-power conservation mode.

The conventional components of the electrical block diagram include the plug 11, which is used to connect the refrigerator into a conventional 120 volt, 60 hertz appliance grounding receptacle (a part of the house wiring), an electrically powered compressor motor 12 for circulating coolant through an evaporator in order to cool the refrigerator, a thermostat 13 designed to turn on the compressor motor when the refrigerator temperature is too high and turn it off when the refrigerator temperature is too low, a defrost heater 14 for removing frost from the evaporator which builds up during the cooling cycle, a defrost timer 15 designed to operate the compressor for one interval and the defrost heater for another interval, and a defrost thermostat 16 designed to turn off the defrost heater when the frost is removed from the evaporator.

In a conventional refrigerator, the foregoing elements 1–16 (not including the defrost delay relay 17), comprise a conventional highly reliable defrost system. These elements (1–16) are interconnected in the following manner. The plug 11 includes a pin or terminal T1 for connection to the "hot" connection in the house wiring receptacle, a pin or terminal T2 for connection to the neutral connection in the receptacle and a pin or terminal T3 for connection to the ground connection in the receptacle. The plug terminal T1 is connected to the "hot" bus 18 of the refrigerator power wiring, the plug terminal T2 is connected to the neutral bus 19 of the refrigerator power wiring, and the plug terminal T3 is connected to the frame of the refrigerator for grounding it to the ground in the wiring receptacle. The thermostat 13 is a conventional vapor filled bellows activated device having a pair of contacts S1 and S2 which close when the refrigerator temperature is above a desired value. The thermostat contact S1 is connected to the "hot" electrical bus 18 for application of power to the circuit and the thermostat contact S2 is connected to the defrost timer, which in turn controls the compressor 12 and defrost heater 14, which are the loads of the circuit. The defrost timer 15 consists of a timer motor having terminals M1 and M2 and a single pole, double throw switch having a pole contact S3 and stationary contacts S4, S5. The timer pole contact S3 and the timer motor terminal M1 are both connected to the thermostat contact S2. The other terminal of the timer motor (M2) is connected through the contacts (S9, S10) of the defrost delay relay 17 and, which for purposes of the present discussion are assumed to be closed, to the neutral refrigerator bus 19. The first stationary contact S4 of the defrost relay is connected to one terminal (M3) of the compressor motor 12, while the other motor terminal (M4) is returned to the neutral bus 19. The stationary contact S5 of the defrost relay is connected to one terminal of the defrost heater 14. The defrost thermostat is conventional, electrically equivalent to a single pole, single throw switch as illustrated. The contact S6, which contacts S7 under "cold" conditions, is connected to the other terminal of the defrost heater 14 and the other contact S7 is connected to the neutral refrigerator bus 19. This mode of connection allows the heater to be turned off earlier than allowed by the timer once the frost has been removed from the evaporator.

The foregoing elements of the defrost system are set conservatively to insure against frost accumulation. Typically, the timer is set so that the compressor will run between five and eight hours, a long enough interval to insure that under the most humid conditions and maximum door openings that the accumulated frost on the refrigerator in question will not be greater than the defrost heater can remove in one heating period. The defrost heater is set to operate for a fixed maximum period, typically thirty minutes, by means of the timer, as noted above. The period is often shortened by the defrost thermostat which senses when the evaporator coils are frost free and turns off the heater. If the heater is turned off after perhaps 25 minutes, the timer then continues in the defrost position for the 5 minutes balance of the period allocated for frost removal. At the end of the defrosting period, the defrost timer then allows the compressor to come back on and reinstitute the cooling cycle.

Figure 2:
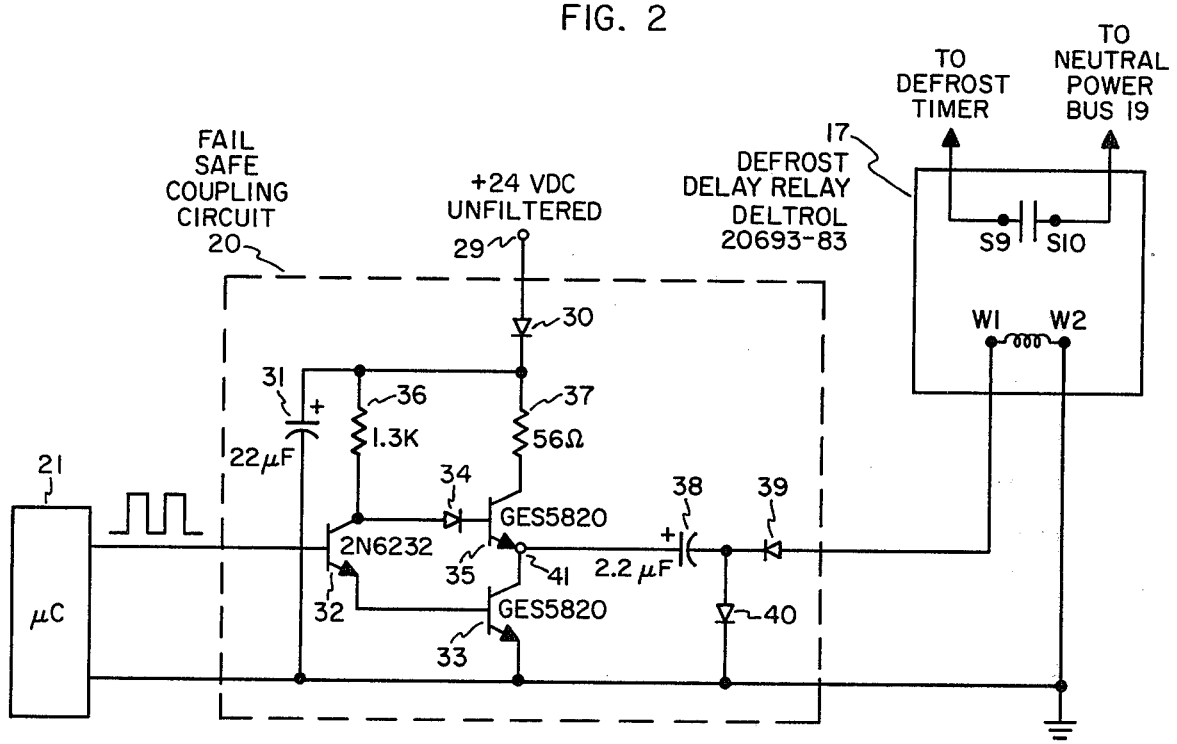
FIG. 2 is an electrical circuit diagram illustrating a portion of a refrigerator control system in which a microprocessor is coupled to a defrost delay relay through a novel fail-safe coupling circuit.

The power conservation components of the electrical block diagram of FIG. 1 include the defrost delay relay 17, the fail-safe coupling circuit 20, which is depicted in detail in FIG. 2, the microprocessor 21, the input shift register 22, and the switches 23, 24 and 25. These components delay the defrost period for power conservation without significantly decreasing the reliability of the overall defrost system.

The power conservation elements of the block diagram are interconnected as follows: The defrost delay relay 17 is a device which consists of a pair of normally closed contacts S9 and S10 and a dc operating winding having terminals W1 and W2 which opens the contacts when suitable energization is supplied. Energization for the relay is supplied by the coupling circuit 20, which makes connection to the terminals W1 and W2 of the relay winding. The fail-safe coupling circuit 20 responds to a control signal from the microprocessor 21. (The power connections to the blocks 20 and 21 are not fully shown in FIG. 1.)

The microprocessor 21, which may be used to control several refrigerator functions, responds to several inputs. The first input is a connection to the "hot" refrigerator bus 18, which provides a 60 hertz signal indicative of the passage of time that the refrigerator has been connected to the ac source. Other inputs are provided via the input shift register 22. They include a switch 24, which sets the microprocessor into a vacation mode (on) condition, a switch 25 which sets the microprocessor into a vacation mode (off) condition, and a door switch, which responds to a door opening to produce a vacation mode (off) condition. The operation of these elements will be taken up in greater detail in which follows.

One embodiment of the fail-safe coupling circuit 20, including the microprocessor 21 and the defrost delay relay 17, is illustrated in FIG. 2. The coupling circuit 20 is of maximum reliability with a minimum components count. In the vacation (off) mode achieved by operating the vacation mode (off) switch 25 or opening the refrigerator door, which actuates the door switch 23, the input shift register 22 provides a control input to the microprocessor 21, which causes it to produce no output to the coupling circuit. In the event that the vacation mode (on) switch 24 is operated, the input shift register 22 provides a control input to the microprocessor which causes it to produce no output for a first period of typically 20 minutes followed by a typically 30 minute period in which 1 kHz rectangular pulses of about 1.2 volts amplitude are produced, followed by another 20 minute period in which the microprocessor output is zero, followed by a second 30 minute period during which the pulses occur. The cycle repeats until the defrost timer operates to turn off the compressor. The pulses in the microprocessor output are amplified by the coupling circuit 20 and applied to the operating winding of the defrost delay relay 17. In the indicated sequence, the relay contacts are held open for 30 minutes sequence. The timer motor whose terminals (M1, M2) are serially connected with the defrost delay relay contacts is thus prevented from advancing for 30 minutes in each 50 minute sequence. As a consequence, the defrost cycle which would have provided 5 hours of compressor time between defrostings in the nornal mode, is now extended to 12½ hours in the vacation mode.

The operation of the fail-safe coupling circuit 20, which amplifies the pulse output of the microprocessor to a suitable level to operate the relay 17, and which includes a suitable pulse detection circuit for dc relay operation, may now be explained with reference to FIG. 2. The coupling circuit may be regarded as consisting of an included rectifier-capacitor power supply (30, 31) for providing a filtered low voltage (e.g. 24 volts in FIG. 2), a pulse amplifier consisting of the three transistors 32, 33, 35, diode 34 and load resistances 36, 37, and a pulse detection circuit consisting of capacitor 38 and rectifiers 39, 40. The pulse amplifier has an input threshold below which no output is produced and above which full output is produced. The input threshold is typically about 1.2 volts and the output is slightly less than the dc supply voltage.

The dc power supply 30, 31 of the coupling circuit is designed to operate from 24 volts of unfiltered dc available at terminal 29, and which is normally obtained from a separate step-down transformer from the 120 V 60 cycle main. The anode of the rectifier 30 is coupled to terminal 29. The cathode of rectifier 30, which becomes the positive terminal of the internal dc supply, is coupled to one terminal of the filter capacitor 31. The other terminal of the capacitor 31 is connected to a ground connection common to the 24 volt transformer secondary and the coupling circuit wiring. The filter capacitor 31 is typically 20 microfarads and provides a substantial amount of energy storage.

The pulse amplifier of the fail-safe coupling circuit 20, which includes the three transistors 32, 33 and 35, has an input terminal corresponding to the base electrode of the transistor 32 to which the 1 kHz output of the microprocessor is connected, a common or ground terminal, and an output terminal 41 from which an amplified 1 kHz pulse is derived for coupling to the pulse detection circuit (38, 39, 40).

The elements of the pulse amplifier are interconnected as follows. The transistor 32 has its emitter connected to the base of the transistor 33 and its collector connected through a first load resistance 36 to the positive terminal of the internal dc supply 30, 31. The collector of transistor 32 is also connected to the anode of diode 34 whose cathode is connected to the base of transistor 35. The emitter of transistor 33 is connected to the ground connection. The collector of transistor 33 is connected to the emitter of transistor 35. The collector of transistor 35 is connected through a second load resistance 37 to the positive terminal of the internal dc supply 30, 31. The output of the pulse amplifier appears at the interconnection 41 between the collector of the transistor 33 and the emitter of transistor 35.

The foregoing circuit (32–37) amplifies pulses from the microprocessor. Assuming that microprocessor 21 is in a first, quiescent condition (the zero state), and has an output at or near zero, the input junctions of transistors 32 and 33 are at near zero bias and both transistors are off. At the same time, the input junction of transistor 35, whose emitter may be assumed to be coupled to ground through an as yet not fully described load, and whose base is returned to B+ through diode 34 and resistance 36, becomes forward biased, turning on transistor 35 and coupling the nearly full dc voltage of the internal dc supply to the amplifier output terminal (41). In the second, active condition corresponding to the one state of the microprocessor, a pulse exceeding the 1.2 volts input threshold of the amplifier is applied. The microprocessor output is sufficient to forward bias the serially connected input junctions of transistors 32 and 33, causing both transistors to conduct. Conduction by transistor 32 reduces the bias applied to the base of transistor 35 toward ground potential turning transistor 35 off. Conduction by transistor 33 forces the potential at output terminal 41 to fall to near ground potential. Considering both states dynamically, when a 1 kHz pulse is applied from the microprocessor to the pulse amplifier at a value exceeding approximately 1.2 volts, an output pulse of the same frequency at slightly under 24 volts will appear at the output terminal 41 for coupling through the detection circuit to the operating winding of relay 17.

The pulse detection circuit 38, 39, 40 couples the output energy from the pulse amplifier to the operating winding of the relay in an essentially dc form. The input terminal of the pulse detection circuit is a first terminal of the 2.2 microfarad capacitor 38. The second terminal of the capacitor 38 is connected to the cathode of diode 39 and the anode of diode 40. The anode of diode 39 is connected to the W1 terminal of the relay actuating winding and the cathode of the diode 40 is connected to the grounded terminal W2 of the relay actuating winding.

The detection circuit functions in the following manner. Assuming that the microprocessor is in a one state in a pulse train and that the transistor 35 is conductive, the capacitor 38 receives a positive charge of approximately 24 volts on the electrode connected to the terminal 41. The charging path includes in succession the diode 30, the 56 ohm load resistance 37, transistor 35, capacitor 38 and diode 40. When the capacitor 38 is charged, which normally occurs before the "1" state of the pulse is ended, the transistor 35 becomes less conductive. When the "0" state of the pulse occurs, transistor 35 is turned off strongly by conduction of transistors 32, 33. At output terminal 41, the transistor 33 provides a conductive path to ground. This allows the positive charge on the capacitor 38 to begin discharging through a path which includes from ground, the relay actuating winding, diode 39, capacitor 38, and the transistor 33 (collector and emitter) to ground to complete the circuit. The rate of capacitor discharge is limited by the inductance of the relay winding. When the next "1" of the microprocessor occurs, the capacitor 38 is recharged through the charging path. During the next "0" state, the capacitor is again discharged through the relay winding. The amount of energy coupled into the capacitor from the pulse amplifier for each conduction period is fixed by the capacitor 38 and B+. The amount of energy coupled per conduction period into the detection circuit by the capacitor tends to be independent of frequency so long as the duration of the on time of the pulse exceeds about 5 times the time constant of the charging circuit.

During the period that the pulse amplifier is in a zero state in a pulse train, the capacitor 38 discharges through a circuit which includes the inductance of the relay operating winding. The circuit is designed for roughly optimum energizing current in the relay. With a suitably optimized load, the pulse detection circuit then becomes frequency dependent. In other words, the average current equals the charge per conduction pulse times the pulse repetition rate. With a constant charge per pulse the average current becomes directly proportional to the pulse repetition rate. Practically, the relay will usually operate for pulses at a repetition rate somewhat below 1000 per second, e.g., 500 Hz but will not operate for unfiltered ripple waveforms such as the 50 Hz or 120 Hz corresponding to the ripple frequencies that might occur with filter capacitor failure. Pulses at these ripple frequencies are incapable of coupling sufficient energy to the capacitor to actuate the relay. Meanwhile, the capacitive coupling prevents the relay from being sensitive to dc quantities.

In the foregoing FIG. 2 embodiment, it is highly unlikely that the electronics can open the delay relay unless there are no electronics failures. If the microprocessor or its supporting power supply were to fail, the square wave would not be present and no current would flow through the relay. If transistors 32, 33, 35 or diode 34 were to fail, the square wave would not appear at the capacitor 38 and no current would flow. For the system to fail, would require rectifier 39 to fail as a short circuit, rectifier 40 to fail as an open circuit, capacitor 38 to fail as a short circuit and transistor 35 to be in saturation or shorted. The +24 VDC supply must also be operational at the time. Under any other combination of failures other than the one described, delay relay 17 will not open and the defrost system will remain intact.

The fail-safe coupling circuit is also of a conservative electrical design. The input threshold which establishes which of two output states the pulse amplifier is in, is established by the input junction drops of the two transistors 32 and 33, and is of high reliability. Since the pulse amplifier produces a binary output in which there is a high state and low state, any gradual deterioration in the transistor gain will not produce circuit failure since there is a very substantial excess gain. The remaining capacitors, resistors and diodes are all of high reliability, and when selected with conservative ratings, they provide a high reliability configurations comparable to the 20 year design life of the mechanical refrigerator components.

Figure 3:
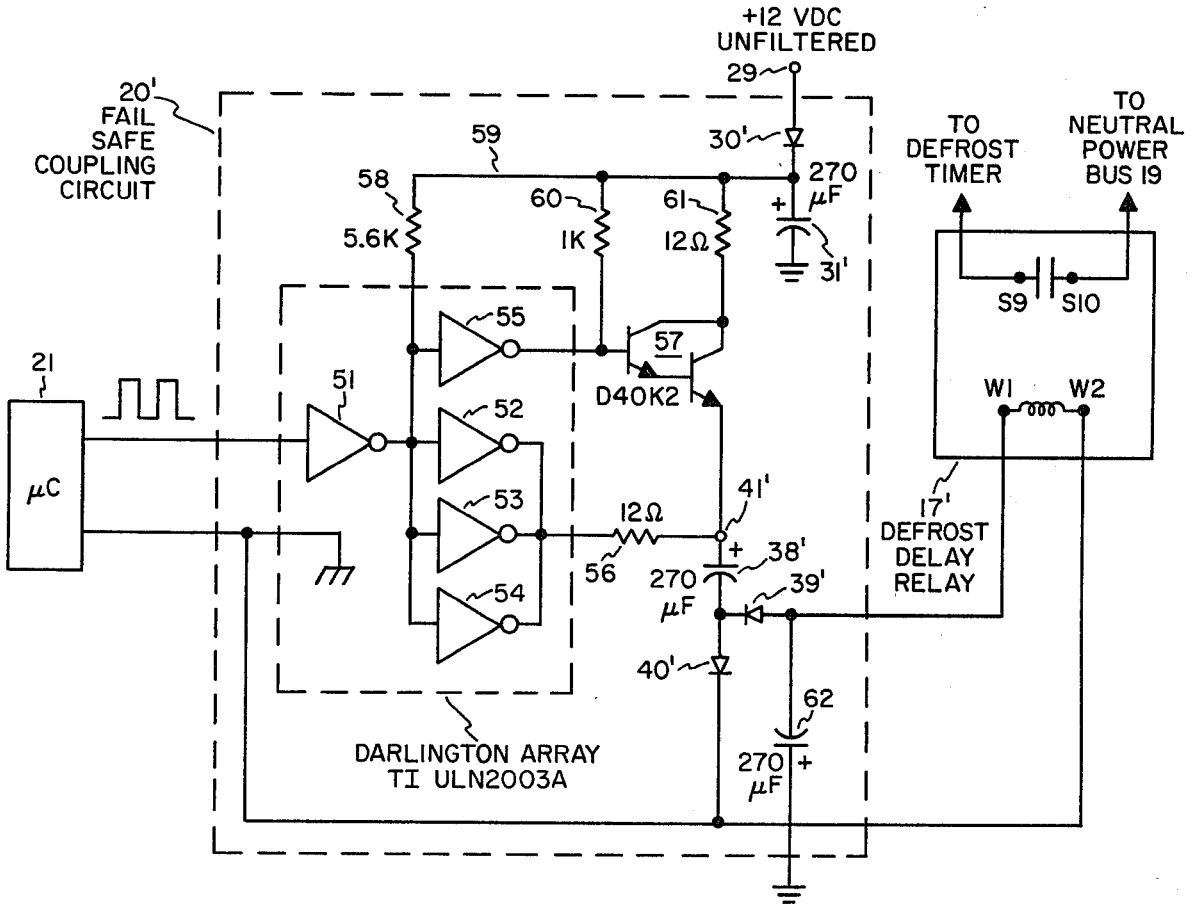
FIG. 3 illustrates a portion of a refrigerator control system similar to that in FIG. 2, with an alternative form of fail-safe coupling circuit.

A second embodiment of the fail-safe coupling circuit is illustrated in FIG. 3. Where similar components are recited in FIG. 3, primed reference numerals have been employed. The FIG. 3 embodiment is in a low cost commercial form employing a commercially available Darlington array and includes a capacitor in parallel with the defrost delay relay operating winding to reduce relay chatter and a resistance in the discharge path of the coupling capacitor to preclude excessive currents during discharge. In the pulse amplifier, the Darlington elements of the array, which bear the reference numerals 51 to 55, and a separate Darlington 57 are the active elements. The input of the first Darlington 51 is coupled to the output terminal of the microprocessor 21 and the output thereof (an inverting output) is coupled to the four inputs of the Darlingtons 52 to 55. The output of 51 is coupled through resistance 58 to the B+ bus 59. Three of the Darlingtons, 52, 53 and 54, have their inputs and their outputs paralleled, the paralleled output being serially connected through the 12 ohm current limiting resistance 56 to the output terminal 41' of the pulse amplifier. The Darlington 55 has its output coupled to the base of a separate Darlington 57, the base electrode of which is coupled through load resistance 60 to a B+ bus 59. The output collector of the Darlington 57 is coupled through a 12 ohm resistance 61 to the B+ bus 59. The emitter of the Darlington 57 is coupled to the output terminal 41'. The pulse detection circuit is similar to that shown in FIG. 2 except for the addition of the capacitor 62.

The foregoing pulse amplifier and pulse detection circuits function in much the same manner as their counterparts in the first embodiment. When the output of the microprocessor 21 is in a high or "1" state, the output of the first Darlington 51 is low and the output of the second rank of Darlingtons (52 through 55) is high. Noting that the Darlingtons 52, 53 and 54 are internally grounded, and have collectors which are unconnected to B+, this state produces an open circuit condition between resistance 56 and the internal ground of the array. Simultaneously, the Darlington 55 has an open connection between the output circuit and ground. This allows the separate Darlington 57 to be turned on by current flowing through resistance 60. In the microprocessor one state, therefor, the voltage at output terminal (41') of the pulse amplifier approaches the B+ potential (12 volts). This allows the capacitor 38' to be charged through the diode 40' in the same manner as in the first embodiment.

Assuming that the output waveform of the microprocessor in a pulse sequence, the next interval produces a "0" state. With a "0" state at the input of stage 51, a "1" is applied to the input of the second rank of Darlington amplifiers 52 to 55. This causes strong conduction through the Darlingtons 52, 53, 54 which discharges the capacitor 38' through a path including the resistance 56, the three Darlingtons 52–54 and ground. The balance of the path includes the rectifier 39' with a significant portion of the initial current source being conducted through the capacitor 62 in shunt with the winding of relay 17'. At the same time that the three Darlingtons 52 to 54 are connecting the output point 41' to ground, the Darlington 55 is also connecting. Darlington 55 connects the base of the separate Darlington 57 to ground, turning it off.

Thus, the pulse amplifier in the second embodiment alternately connects the output terminal 41' through a low impedance to B+ and through a high impedance to ground in the capacitor charging state (when the microprocessor is in the "1" state) and to B+ through a high impedance and to ground with a low impedance during the period that current is being supplied to the delay relay (when the microprocessor is in the "0" state). The operation of the FIG. 3 embodiment is accordingly very similar to that of the first embodiment but has the advantage of permitting lower costs in the context of other control requirements in the refrigeration system.

Returning to system operation, when the relay energizing pulses occur at a sufficiently high rate, e.g. 1,000 pulses per second, sufficient current flows to energize the defrost delay relay 17' and it is held in an open position which prevents the defrost timer 15 from advancing. The defrost timer, which is under control of the microprocessor, is designed to be on for a first specified period (20 minutes) and off for a second specified period (30 minutes) so as to defer the period of the next defrost, as previously described, when in the vacation mode.

The microprocessor is designed to produce a signal which indicates with a high degree of probability that it is functioning properly. While that signal could take a number of different forms, the 1,000 pulse per second rectangular format has that basic property, and is initiated when a suitable input is provided by operation of the vacation mode on switch.

Figure 4:
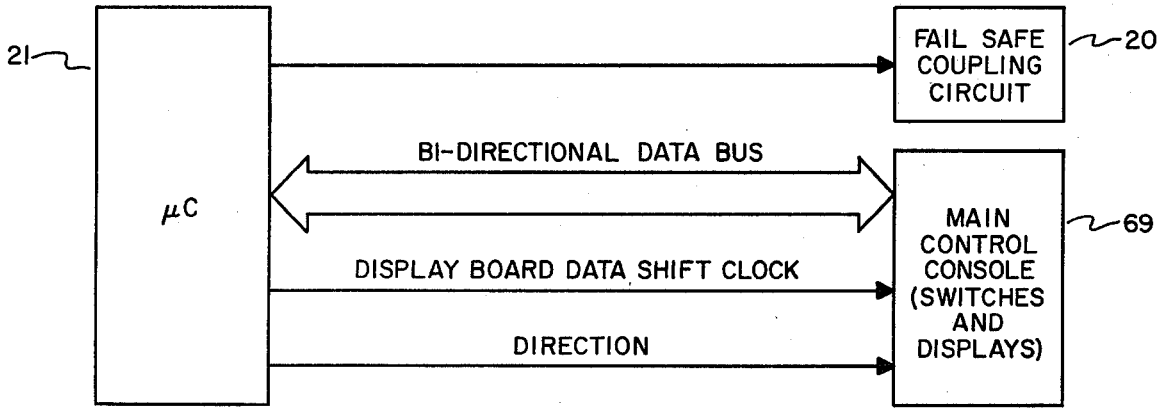
FIG. 4 is a simplified block diagram showing the interconnections between the microprocessor, a control console on the refrigerator and the fail-safe coupling circuit.

The refrigerator in the present arrangement is provided with a main control console 69 as illustrated in FIG. 4, which is mounted upon the refrigerator door. The control console is a unit which accepts information from the user and also displays information to the user. Information is accepted by means of input switches and information is supplied to the user by means of output displays. As illustrated in FIG. 4, the microprocessor 21 and the main control console are linked by a plurality of connections including a main bidirectional data bus and buses for the display board and data shift clock and direction data. The arrangement permits the cycling of information from the input switches on the main console to the microprocessor and from the micoprocessor to the displays on the main control console under microprocessor control. More particularly, data from the input switches are "strobed" into a parallel to serial shift register (22) located in the control console and that data is then read serially into the microprocessor. The parallel to serial conversion minimizes the number of actual connections between the microprocessor and the control console. Two of the bits in the latter data stream are from the vacation mode "ON" and vacation mode "OFF" switches which are manually pressed by the user. The microprocessor intepreets the status of these bits and performs a time integration function requiring switch closure for several successive cycles before recognizing that the vacation mode switch is "ON". This process is referred to as a "debounce" function.

Once the vacation mode "ON" condition has been recognized, the microprocessor is programmed to duty cycle modulate the defrost timer by alternately opening and closing relay 17 as earlier described. It accomplishes this by applying a 1 kHz square wave to the fail-safe coupling circuit (2) when the relay is to be open and removing the signal when the relay is to be closed. The generation of the 1 kHz square wave may best be understood by reference to FIG. 5 which is an illustration in block diagram form of a typical microprocessor. The MK 3870 is a commercially available example of such a microprocessor.

The microprocessor consists of 13 blocks (71–83) generally linked by a main data bus (70) and connected to the control console through N input-output ports (71). One of these input-output ports is connected to the input shift register 22 within the control console. The microprocessor includes an arithmetic logic unit (72) and an accumulator and status register (73). The microprocessor employs a ROM address register (74) recirculating information through an adder (75) whose other input is coupled to the main data bus 70. The block 74 supplies an output via a program ROM (76) to the main data bus. Also coupled to the main data bus is an indirect scratch-pad address register (77) whose output is coupled to a scratchpad RAM (78), the latter recharging data with the main data bus. The microprocessor is under control of the control logic (79) and instruction register (80). Timing is achieved through a timer (81) and interrupt logic (82). A crystal LC, or RC, clock is shown at 83.

In order to generate a square wave pulse at one of the output ports, the program ROM 76 first outputs a logic level (high or low) to the appropriate input output port. The program ROM then leaves the port in that state for a length of time T which can be accurately timed by the internal timer (81). At the end of the "T" interval the program ROM then forms the logical complement of that bit, which it then outputs to the input-output port for an additional time. If the process is repeated ad-infinitum a square wave results at the input-output port. For a 1 kHz square wave T is 500 microseconds.

The presence of a square wave is an indication of high probability that the portion of the microprocessor controlling the defrost delay relay 17 is operating properly. The most probable result of a catastrophic component failure in this part of the circuit is that the input-output port would become locked in one of two permissible states. This is true of digital electronic components in general; they generally fail either shorted or open circuited. Because of the complexity of a microprocessor, the two states generally assumable upon failure are (to a first approximation) equally likely. By requiring a square wave output, the system is able to react to a failure in either mode.

Figure 5:
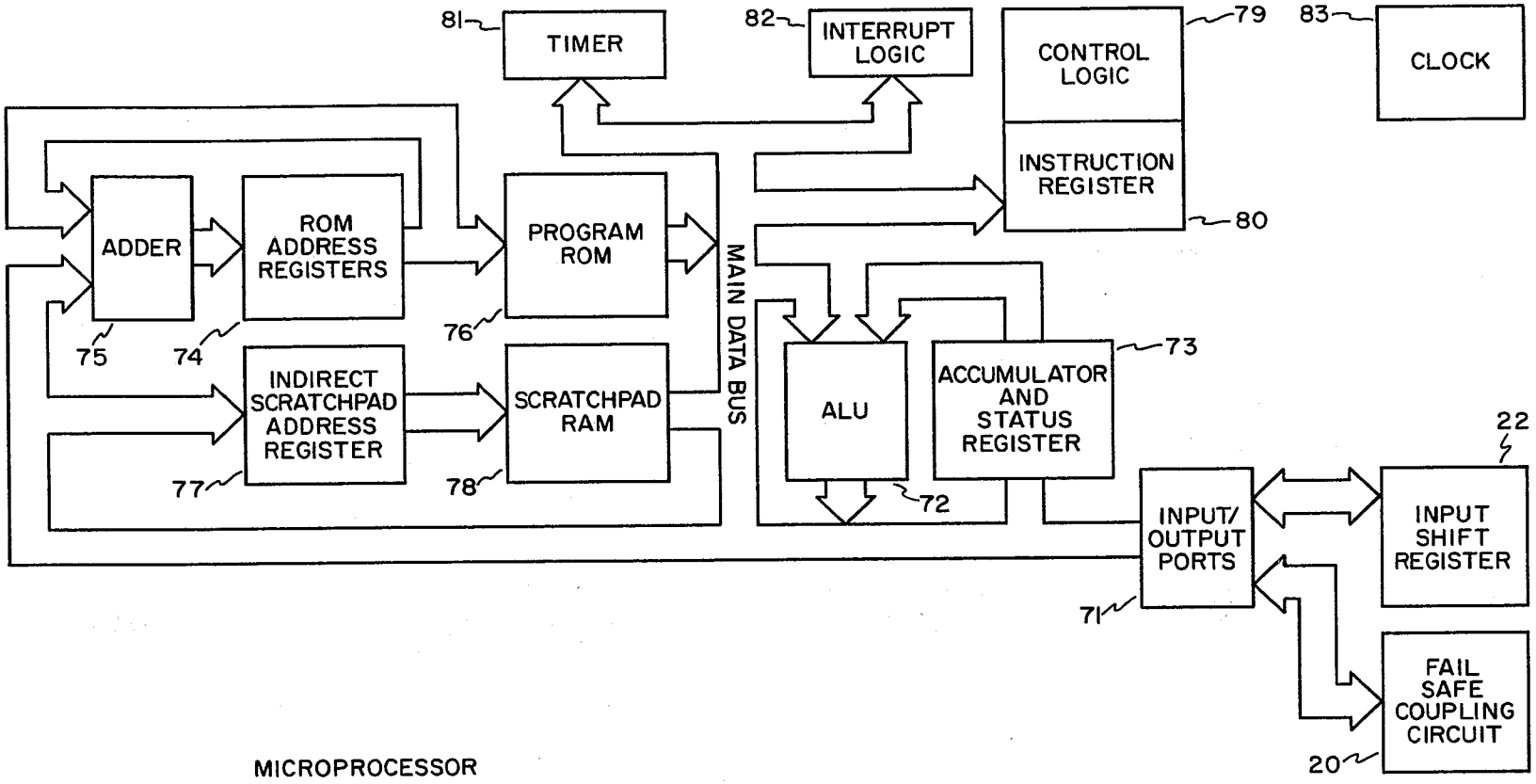
FIG. 5 is a simplified block diagram of a microprocessor suitable for use in a refrigerator control system.

FIG. 5 is representative of microprocessors in general. All of the functional blocks are used in generating the high frequency square wave with the principal exception of the unused input-output ports. The blocks used in generating the square wave are also used in performing all of the other functions of the refrigerator logic such as the calendar indication, door open alarms, etc. Since this is a synchronous system, a catastrophic failure will most probably cause the machine to "stop" in some state, and hence a square wave will not be produced. For more subtle failures such as a bad ROM, or a scratchpad failure, it may be possible for the machine to generate a square wave of the correct frequency, but for such to happen, multiple failures of a non-catastrophic variety are required, a situation which has a low probability of occurrence. The only single failure likely to cause this condition is the failure of a particular bit of the scratchpad register (that bit which tells the microprocessor to generate the square wave), and even in this case, additional software can be used to detect and ignore this condition.

The program which generates the square wave is resident in the program ROM (76). The status of the square wave is kept in the scratchpad RAM (78), and the timer (81) and interrupt logic (82) are used to generate the time base T. In addition, blocks (74, 75, 77, 79, 80, 83) are used in the transfer and manipulation of data and program instructions.

What is claimed is:

1. In a self-defrosting refrigerator, the combination comprising:

(a) a refrigeration system including an evaporator for cooling the refrigerator interior by evaporation of a circulating coolant, said evaporator being subject to frost build-up during cooling, (b) first and second input terminals for connection of said refrigerator to a source of electrical energy, (c) an electrically powered motor driven compressor for circulating coolant through said refrigerator system, (d) a thermostat having contacts for turning on or turning off the compressor motor to maintain the refrigerator temperature at a desired value, (e) a defrost heater for removing frost build-up from said evaporator, (f) a time responsive switch for setting a minimum period between defrostings having (1) a timing motor, and (2) a two condition switch, one for operation of said compressor and the second for operation of said defrost heater, as a function of the duration of timing motor energization, (g) a normally closed defrost delay relay for extending said minimum period between defrostings having:

(1) an operating winding, and (2) a pair of normally closed contacts which open when said operating winding is suitably energized, said thermostat contacts, said timing motor, and defrost delay relay contacts being serially connected between said first and second input terminals for energization of said timing motor only when both thermostat and defrost delay relay contacts are closed, (h) an electronic decision element responsive to input information supplied thereto for determining the period between defrostings beyond said minimum period, said decision element producing an output signal having a duration dependent on said input information, and (i) means coupling the output signal of said decision element to said relay operating winding for opening said relay contacts to achieve said extension.

2. The combination set forth in claim 1 wherein said electronic decision element is an integrated circuit arrangement, the output signal thereof being a sequence of pulses, characteristic of proper operation of said decision element.

3. The combination set forth in claim 1 wherein (a) said source of electrical energy is of a low frequency, (b) the output signal of said decision element is a sequence of pulses at a substantially higher frequency than said source frequency, and (c) said coupling means provides frequency dependent coupling for relay response to said periodic pulses and non-response to direct current or low frequency alternating current quantities.

4. The combination set forth in claim 1 wherein a user operated switch is provided as an information input to said electronic decision element, one setting thereof extending the period between defrostings beyond said minimum period.

5. The combination set forth in claim 4 wherein a door operated switch is provided as an information input to said electronic decision element, opening of said door establishing the period between defrostings at said minimum period.

6. The combination set forth in claim 3 wherein said coupling means comprises:

(a) an amplifier having an input, an output and a common terminal, said pulses from said decision element being applied to said input terminal, and (b) a pulse detection circuit having an input, an output and a common terminal, the input terminal thereof being connected to the output terminal of said amplifier, and the output terminal thereof being coupled to one terminal of the operating winding of said relay, the common terminals of said pulse amplifier, pulse detection circuit and the second terminal of said operating winding being connected together.

7. The combination set forth in claim 6 wherein (a) said amplifier is a pulse amplifier having a predetermined input threshold and a binary output characterized by a first and second output state dependent on whether or not the input signal exceeds said threshold, and (b) the output of said decision element is a sequence of periodic pulses exceeding said amplifier threshold.

8. The combination set forth in claim 7 wherein said pulse detection circuit comprises:

(a) a capacitor having a first and a second terminal, the first terminal thereof being coupled to the output of said pulse amplifier, (b) a first and a second rectifier, respectively serially connected in like polarity between said first and said second terminals of said operating winding, the second terminal of said capacitor being connected to the rectifier interconnection, said rectifiers being connected in a sense to charge said capacitor through said second rectifier when the pulse amplifier output is in a first output state and to discharge said capacitor through said first rectifier and said operating winding when the pulse amplifier output is in a second output state.

9. The arrangement set forth in claim 8 wherein said capacitor value is selected to provide sensitive relay operation at the frequency of said sequence of pulses with insensitivity to periodic waveforms at fundamental or ripple frequencies of said source.

10. The combination set forth in claim 9 wherein said pulse amplifier comprises:

(a) a dc bias supply having a first and a second terminal, the second terminal of which is connected to the second terminal of said operating winding, (b) two transistor amplifiers each having an input, an output and a common electrode, and (c) a first load resistance: interconnected as follows:

(1) the output of said decision element being coupled to the input electrode of said first and second transistor amplifiers in a sense to turn the first amplifier on and the second off in the first state of the decision element;

(2) the common electrode of said first amplifier being coupled to the first terminal of said capacitor and the output electrode of said first amplifier being coupled through said load resistance to the first terminal of said dc bias supply;

(3) the common electrode of said second amplifier being connected to the second terminal of said dc bias supply and the output electrode of said second amplifier being connected to said first terminal of said capacitor;

said circuit operating as follows:

said first amplifier being off and said second amplifier being on when the output from said decision element is in the first state to apply a charging voltage from said bias supply to said capacitor;

said first amplifier being on and said second amplifier being off when the output from said decision element is in a second state to discharge said capacitor to energize said relay.

11. The combination set forth in claim 9 wherein said pulse amplifier comprises:

(a) a dc bias supply having a first and second terminal, the second terminal of which is connected to the second terminal of said operating winding;

(b) a first, a second and a third transistor, each having base, emitter and collector electrodes, (c) a first and a second load resistance; interconnected as follows:

(1) the output of said decision element being coupled to the base of said first transistor, (2) the emitter of said first transistor being connected to the base of said third transistor, (3) the collector of said first transistor being connected through said third diode to the base of said second transistor and through said first resistance to the first terminal of said dc bias supply, (4) the collector of said second transistor being connected through said second load resistance to said first terminal of said dc bias supply, (5) the emitter of said second transistor being connected to the collector of said third transistor and to the first terminal of said capacitor, (6) the emitter of said third transistor being coupled to the first terminal of said relay and to the second terminal of said dc bias supply, said circuit operating as follows:

the first and third transistors being off and the second on when the output from said decision element is in a first state to apply a charging voltage from said bias supply to said capacitor, the first and third transistors being on and the second off when the output pulse from said decision element is in a second state to discharge said capacitor to energize said relay.

* * * * *